US010939775B2

(12) United States Patent
Hatton et al.

(10) Patent No.: US 10,939,775 B2
(45) Date of Patent: Mar. 9, 2021

(54) MODULAR FRAMING SYSTEM

(71) Applicant: BUDNICK CONVERTING, INC., Columbia, IL (US)

(72) Inventors: Richard J. Hatton, Wellington, OH (US); Stefan Pabst, Wellington, OH (US)

(73) Assignee: BUDNICK CONVERTING, INC., Columbia, IL (US)

( * ) Notice: Subject to any disclaimer, the term of this patent is extended or adjusted under 35 U.S.C. 154(b) by 0 days.

(21) Appl. No.: 16/353,286

(22) Filed: Mar. 14, 2019

(65) Prior Publication Data

US 2019/0290028 A1 Sep. 26, 2019

Related U.S. Application Data

(60) Provisional application No. 62/645,408, filed on Mar. 20, 2018.

(51) Int. Cl.

| | |
|---|---|
| ***A47G 1/08*** | (2006.01) |
| ***A47G 1/10*** | (2006.01) |
| ***A47G 1/06*** | (2006.01) |

(52) U.S. Cl.

CPC ..... *A47G 1/08* (2013.01); *A47G 1/0605* (2013.01); *A47G 1/10* (2013.01); *A47G 2001/0661* (2013.01)

(58) Field of Classification Search

CPC ..... A47G 1/08; A47G 1/0605; A47G 1/10; A47G 1/065; A47G 2001/0661

USPC ..... 40/782, 783, 729, 730, 791; 38/102.9, 38/102.91

See application file for complete search history.

(56) References Cited

U.S. PATENT DOCUMENTS

| | | | | |
|---|---|---|---|---|
| 4,862,612 | A * | 9/1989 | Sugihara | A47G 1/101 40/782 |
| 8,627,590 | B1 * | 1/2014 | Whitehead | G09F 15/0012 160/395 |
| 2001/0034989 | A1 * | 11/2001 | Geiberger | A47G 1/0611 52/287.1 |
| 2006/0059758 | A1 * | 3/2006 | Zacharias | A47G 1/10 40/782 |
| 2010/0043268 | A1 * | 2/2010 | Powell | A47G 1/10 40/741 |

* cited by examiner

*Primary Examiner* — Joanne Silbermann

(74) *Attorney, Agent, or Firm* — Renner, Otto, Boisselle & Sklar, LLP

(57) ABSTRACT

A modular framing system comprises plastic components that each comprise a single article having unitary construction and which are connectable to form various sized SEG frames. Four unitarily molded corner frame connections each include protrusions receivable by at least four side rails, each of which may be unitarily extruded with a constant profile along the respective lengths of the side rails. The interconnected corner frame connections and side rails define a continuous conduit about the quadrilateral frame for receiving therein respective edges of the tensionable textile. For use with larger tensionable textiles, additional side rails and T-frame connections may be utilized, with each of the T-frame connections comprising a single molded article having unitary construction. At least the frame connections (both corner frame connections and T-frame connections) may be reused for frames of other sizes.

19 Claims, 11 Drawing Sheets

MODULAR FRAMING SYSTEM

FIELD OF THE INVENTION

The present invention relates generally to a modular framing system and more particularly to a plastic modular framing system having addable, omittable, or rearrangeable components allowing for resizing of the frame system to display graphics of various sizes.

BACKGROUND

To display graphics, messages, or art, such as for marketing purposes, one may use a frame to which a textile having the graphic, message, or art may be secured. One example of such frame is a silicone edge graphic (SEG) frame for use in displaying a silicone edge graphic textile. A completed frame includes a gap extending about an inner periphery of the completed frame for receiving the outwardly extending free ends of the tensional textile. The free ends may be compressively retained in the peripheral gap, or may be adhered or fastened in other examples.

A typical frame includes four metal side rails each extending to a 45-degree angle end portion. The side rails are formed from various lengths of uncut rails, which are mitered, or otherwise cut using tools capable of cutting through metal. Once cut, the 45-degree end portions are connected to one another to form a quadrilateral frame. Each of the connections at the four corners is made by a right-angle bracket that is fastenable, usually by screws, into the respective side rails at the respective 45-degree angle end portions. The process of cutting the uncut metal rails can be dangerous and time consuming, produces sharp edged cut portions of the rails, and requires exact measurements and specific tools cable of cutting through the metal. New lengths of cut rails are required to form a differently sized frame in view of the permanent nature of the 45-degree corner alteration to the uncut rails.

SUMMARY

The present invention provides a modular framing system that addresses one or more of these drawbacks of conventional metal silicone edge graphic (SEG) frames. The framing system comprises plastic components that each comprise a single article having unitary construction and which are connectable to form various sized SEG frames. Four unitarily molded corner frame connections each include protrusions receivable by at least four side rails, each of which may be unitarily extruded with a constant profile along the respective lengths of the side rails. The side rails may be easily cut to size using a non-powered tool, such as a saw. The interconnected corner frame connections and side rails define a continuous conduit about the quadrilateral frame for receiving therein respective edges of the tensionable textile. For use with larger tensionable textiles, additional side rails and T-frame connections may be utilized, with each of the T-frame connections comprising a single molded article having unitary construction. At least the frame connections (both corner frame connections and T-frame connections) may be reused for frames of other sizes. Use of the systems eliminates the need for dangerous metal-cutting tools, sharp edges of cut metal rails, and precision cut 45-degree angles, and also may reduce the number of required cuts.

According to one aspect of the invention, a frame connection for forming a part of a frame to display a tensionable textile includes a generally planar base portion and a pair of raised wall portions extending generally orthogonally from the base portion and being spaced apart from one another to define therebetween a gap for receiving and retaining a portion of an edge of the tensionable textile. A pair of protrusions extend outwardly from the base portion along respective longitudinal axes disposed parallel to a plane of the base portion, the respective longitudinal axes extend in directions different from one another, and each protrusion includes a rib extending outwardly from a generally planar outer face of the respective protrusion. Each rib extends longitudinally along the planar outer face in a direction parallel to the respective longitudinal axis of the respective protrusion, wherein the frame connection comprises a single molded article having unitary construction.

The frame connection may include any one or more of the following features:

- the frame being composed of a synthetic polymer,
- wherein the pair of raised wall portions and the pair of protrusions are formed in a manner that the raised wall portions and protrusions are integral with the base portion at the forming of the raised wall portions and protrusions,
- wherein the raised wall portions extend laterally along the base portion to a generally planar end face in common with an end face of the base portion,
- wherein the raised wall portions each extend generally orthogonally from the base portion to respective generally planar faces disposed in a common plane generally parallel to the plane of the base portion,
- wherein each rib extends to an end face of the respective protrusion, the end face spaced from the base portion,
- wherein each rib extends to a tapered end face of the respective rib,
- wherein each rib is disposed along an edge of a generally planar face of the respective protrusion,
- wherein each of the ribs is configured to be crushable relative to the respective protrusion,
- wherein the respective longitudinal axes of the protrusions extend parallel to top faces of the pair of raised receiving portions, the top faces being spaced from the base portion.

According to another aspect of the invention, a modular framing system for forming a frame to display a tensionable textile includes four corner frame connections each including a generally planar base portion, and a pair of raised wall portions extending generally orthogonally from the base portion and being spaced apart from one another to define therebetween a gap for receiving and retaining a portion of an edge of the tensionable textile, the pair of raised wall portions each having a pair of sections extending laterally along the base portion and disposed orthogonal one another. A pair of protrusions extend outwardly from the base portion along respective longitudinal axes disposed parallel to a plane of the base portion and orthogonal one another, and each protrusion includes a rib extending outwardly from a generally planar outer face of the respective protrusion, each rib extending longitudinally along the planar outer face in a direction parallel to the respective longitudinal axis of the respective protrusion. Each corner frame connection comprises a single molded article having unitary construction. The modular framing system further includes four longitudinally extending side rails each comprising a formed article having a unitary construction and a profile extending continuously along a full length of the respective side rail. Each side rail includes a generally planar rail base portion, a pair of raised rail wall portions extending generally orthogonally from the rail base portion and being spaced apart from one another to define therebetween a gap for receiving and retaining a portion of an edge of the tensionable textile, and a rail channel extending a full length of the rail between opposite ends of the respective rail, the rail channel being sized to receive therein a protrusion of a respective corner frame connection at each of the opposite ends of the respective rail. The four corner frame connections and four side rails are interconnectable to form a quadrilateral frame, and the pair of raised wall portions of each corner frame connection are spaced apart a distance equal to a spacing between the pair of raised rail wall portions of each of the rails at each point along each pair of raised corner wall portions or raised rail wall portions, the gaps therebetween interconnecting to define a continuous conduit about the quadrilateral frame for receiving therein respective edges of the tensionable textile.

Each rail channel may have an inner profile sized equivalent to an outer profile of the protrusions absent the additional outer profile of the ribs, the outer profile being disposed about the respective longitudinal axes of the protrusions.

The modular framing system may further include four or more additional longitudinally extending side rails each comprising a formed article having a unitary construction and a profile extending continuously along a full length of the respective side rail, and a pair of T-frame connections, each having three protrusions extending therefrom for being received by three different side rails, and each T-frame connection being interconnectable between a pair of corner frame connections via the additional side rails, wherein each T-frame connection comprises a single molded article having a unitary construction.

The pair of T-frame connections may be connectable to one another a fifth additional extending side rail extending between the pair of T-frame connections along an axis parallel to two end rails being two of the four longitudinally extending side rails.

Each of the frame connections and each of the side rails may be composed of a synthetic polymer.

Each of the side rails may be configured to be formed by an extrusion process.

According to still another aspect of the invention, a method of forming a silicone edge graphic frame includes the steps of (a) providing a frame connection in accordance with claim 1 (b) cutting a pair of side rails each comprising a single formed article of unitary construction and having a constant profile over an entire length of the respective rail along its respective longitudinal axis, the cutting including providing a straight cut set at 90 degrees to the longitudinal rail axis, and the profile including a channel having an inner profile conforming to an outer profile of the protrusions of the frame connection about the respective protrusion longitudinal axes, and (c) inserting each of the protrusions of the frame connection into a channel of a respective cut side rail, wherein the longitudinally extending ribs are received into the channel having the inner profile corresponding to the outer profile of the protrusion absent the rib, thus allowing for a compression fit of the protrusion into the channel.

The frame connection may be a corner frame connection where the pair of raised wall portions each have a pair of sections extending laterally along the base portion and are disposed orthogonal one another.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

The present invention provides a modular framing system that addresses one or more drawbacks of conventional metal silicone edge graphic (SEG) frames. The framing system comprises plastic components that each comprise a single article having unitary construction and which are connectable to form various sized SEG frames. Four unitarily molded corner frame connections each include protrusions receivable by at least four side rails, each of which may be unitarily extruded with a constant profile along the respective lengths of the side rails. The side rails may be easily cut to size using a non-powered tool, such as a saw. The interconnected corner frame connections and side rails define a continuous conduit about the quadrilateral frame for receiving therein respective edges of the tensionable textile. For use with larger tensionable textiles, additional side rails and T-frame connections may be utilized, with each of the T-frame connections comprising a single molded article having unitary construction. At least the frame connections (both corner frame connections and T-frame connections) may be reused for frames of other sizes. Use of the systems eliminates the need for dangerous metal-cutting tools, sharp edges of cut metal rails, and precision cut 45-degree angles, and also may reduce the number of required cuts.

Figure 1:
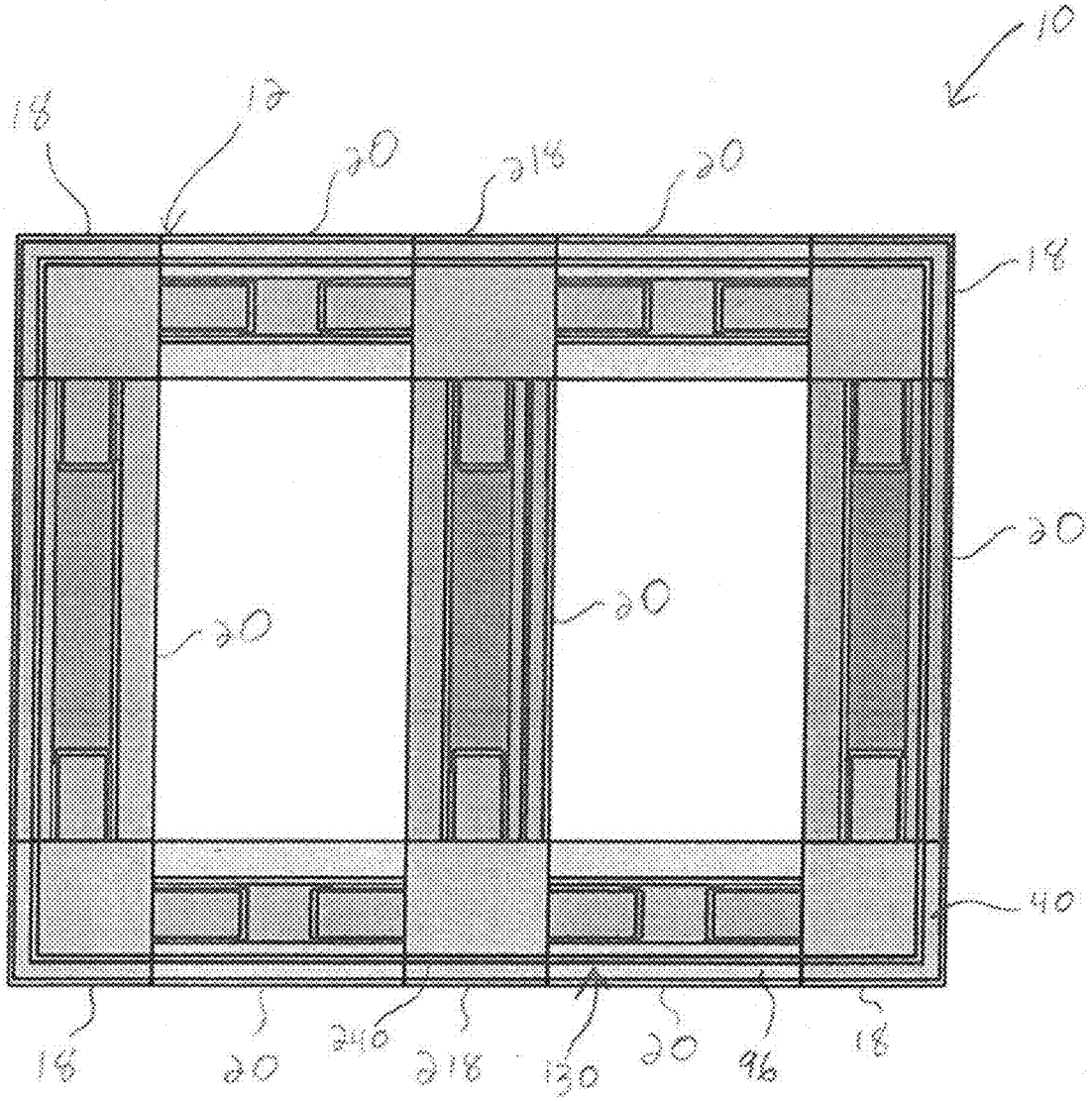
FIG. 1 is a perspective view of an exemplary modular framing system provided in accordance with the present invention for displaying a tensionable textile. The exemplary framing system includes side rails shown in transparent form.
Figure 2:
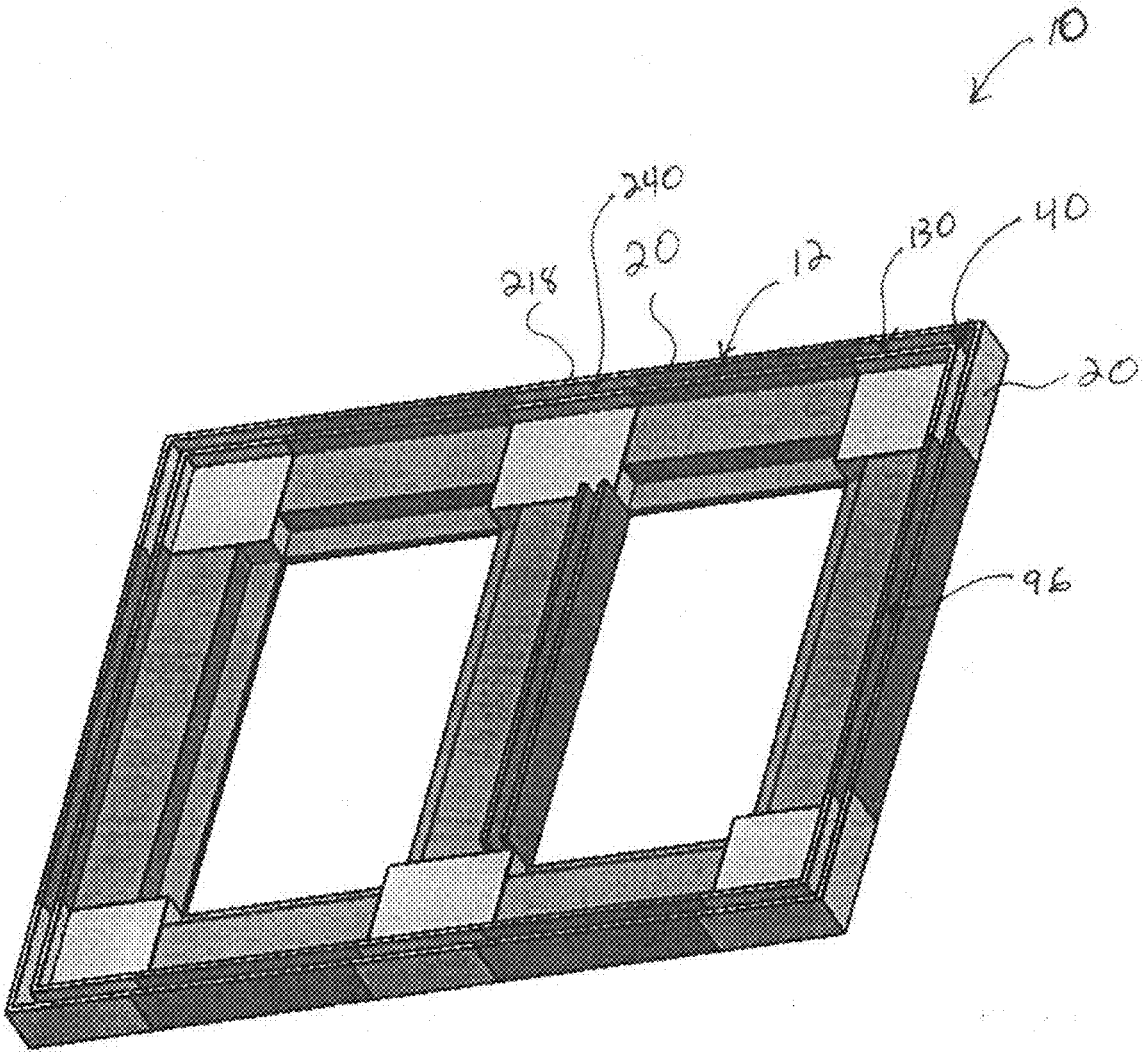
FIG. 2 is another perspective view of the exemplary modular framing system of FIG. 1.

Referring now to FIGS. 1 and 2, the present invention provides a modular framing system 10 for forming a frame 12 to display a tensionable textile. The framing system includes a plurality of framing connections interconnectable with side rails. The connected frame connections and side rails form a frame for receiving and retaining the tensionable textile.

Figure 3:
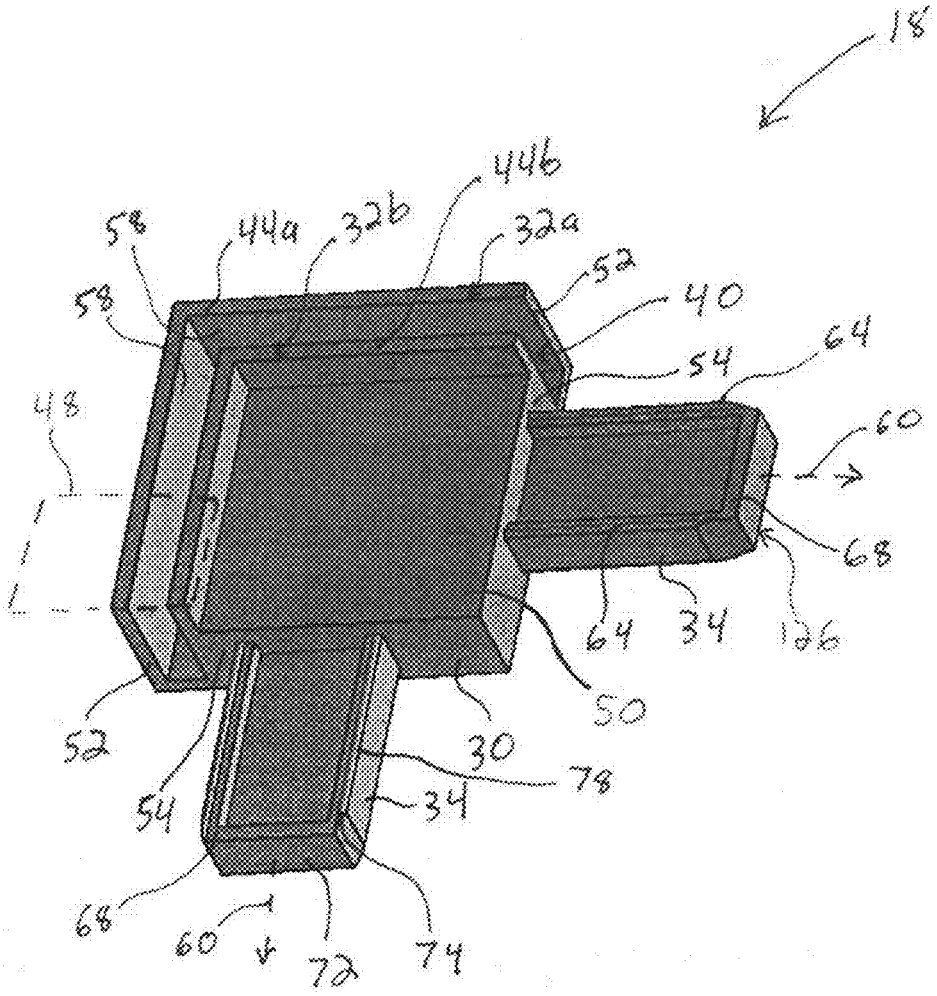
FIG. 3 is a perspective view of a corner framing connection for use in forming the exemplary modular framing system of FIG. 1.
Figure 4:
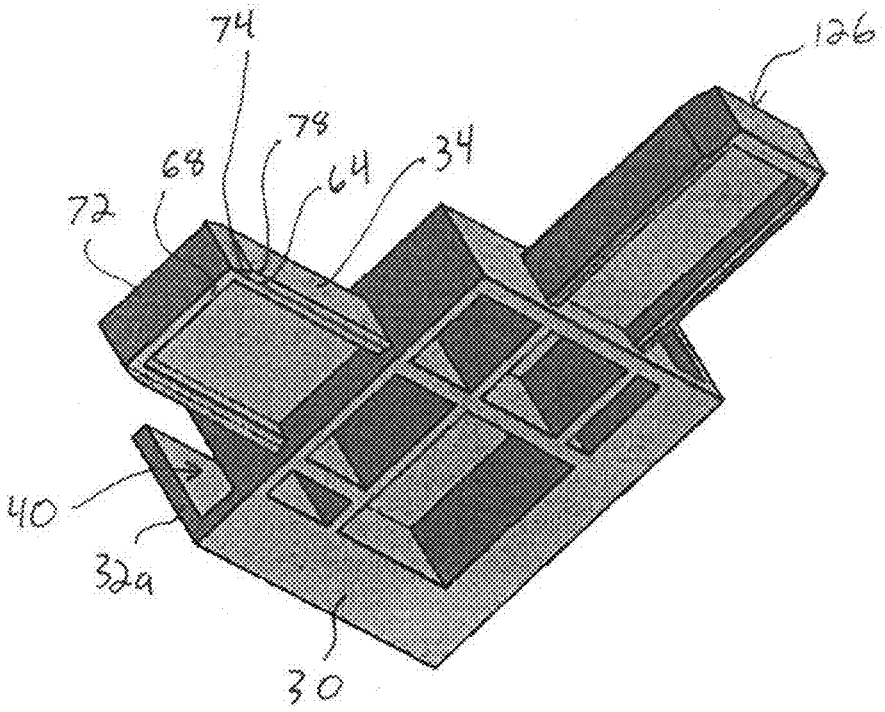
FIG. 4 is another perspective view of the corner framing connection of FIG. 3.
Figure 5:
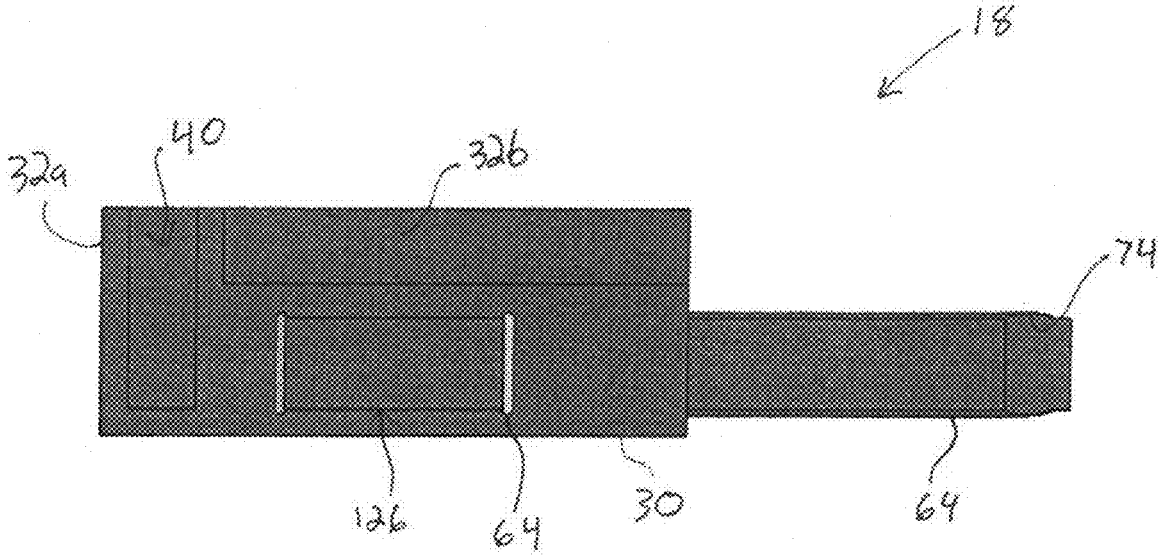
FIG. 5 is a side view of the corner framing connection of FIG. 3.

As shown in FIGS. 1 and 2, and also now turning to FIGS. 3 to 5, the frame 12 is formed using four frame connections, and specifically four corner frame connections 18, that are interconnected with a plurality of side rails 20 to form the frame 12 having a quadrilateral shape. Each frame connection generally includes a base portion 30, at least a pair of raised wall portions 32 extending to elevated heights relative to the base portion 30, and at least a pair of protrusions 34 extending outwardly from the base portion 30.

The base portion 30 is generally planar and provides a generally flat surface for being received against a display surface, such as a wall or support stand. The base portion 30 may include holes for allowing fastening of the corner frame connection 18 relative to such a display surface.

The pair of raised wall portions 32 extend generally orthogonally from the base portion 30 and are spaced apart from one another to define therebetween a gap 40 for receiving and retaining a portion of an edge of the tensionable textile. The outermost wall portions 32*a* and 32*b* define the gap 40 therebetween, with the wall portions 32*a* and 32*b* being equidistantly spaced apart at opposed axial ends of the wall portions 32*a* and 32*b*, and along the lengths of the wall portions 32*a* and 32*b*.

Each of the wall portions 32*a* and 32*b* extends generally orthogonally from the base portion 30 to respective generally planar faces 44*a* and 44*b* disposed in a common plane 48 that is generally parallel to a plane 50 along which the base portion 30 extends. Each of the wall portions 32*a* and 32*b* also extends laterally along the base portion 30 to opposite respective generally planar end faces 52 disposed in common with end faces 54 of the base portion 30. The end faces 52 and 54 are disposed orthogonal the plane 50 providing for easy and modular mating of the frame connections 18 and side rails 20. In this way, specific angular faces need not be matched/mated.

With respect to the specific corner frame connections 18, the raised wall portions 32*a* and 32*b* each have a pair of sections 58 extending laterally along the base portion 30 and disposed orthogonal one another. Each pair of sections 58 forms a respective wall portion 32*a* or 32*b*.

A pair of protrusions 34 extend outwardly from the base portion 30 along respective longitudinal axes 60 disposed parallel to the plane 50 of the base portion 30. The respective longitudinal axes 60 extend in directions different from one another, and with respect to the specific corner frame connection 18, in directions orthogonal to one another. The respective longitudinal axes 60 of the protrusions 34 extend parallel to top faces 44*a* and 44*b* of the raised receiving portions 32*a* and 32*b*. The top faces 44*a* and 44*b* are spaced from the base portion 30.

Each protrusion 34 includes a rib 64 extending outwardly from a generally planar outer face 68 of the respective protrusion 34. The illustrated protrusions 34 each include a pair of ribs 64 extending outwardly, in a direction orthogonally away from the base portion 30, at each of upper and lower faces 68 of the protrusions 34. The pair of ribs 64 each have a rounded profile, although other profiles may be suitable in other embodiments.

Each rib 64 extends longitudinally along the planar outer face 68 in a direction parallel to the respective longitudinal axis 60 of the respective protrusion 34, between the base portion 30 and a respective end face 72 of the respective protrusion 34. Each rib 64 extends to a tapered surface 74, allowing for easier receipt of the protrusion 34 and ribs 64 by the side rails 20. The illustrated pairs of ribs 64 are each disposed along opposite lateral edges 78 of the respective faces 68 of the respective protrusions 34, which each have a generally quadrilateral, such as rectangular, profile absent the ribs 64.

Other numbers, one or more, of ribs 64 and locations thereof may be suitable in other embodiments. Other shapes or profiles of the protrusions 34 also may be suitable in other embodiments.

Each of the ribs 64 may be configured to be crushable relative to the respective protrusion 34, to allow for a compression fit in a respective side rail 20. Such compression fit also may be enabled where the ribs 64 are not configured to be crushable. The relative dimensions of the ribs 64 being a fraction of a lateral width of the protrusion 34 between the lateral edges 78 may provide for the crushability of the ribs 64.

Each frame connection, such as the corner frame connections 18, comprises a single molded article having unitary construction, in that it is formed as a single piece. For example, the raised wall portions 32*a* and 32*b* and the pair of protrusions 34 are formed in a manner that the raised wall portions 32*a* and 32*b* and protrusions 34 are integral with the base portion 30 at the forming of the raised wall portions 32*a* and 32*b* and protrusions 34. For example, the one-piece part can be made preferably of a single material, e.g., a synthetic polymer such as nylon, polypropylene, or polyethylene with a molding process, such as an injection molding process.

Figure 6:
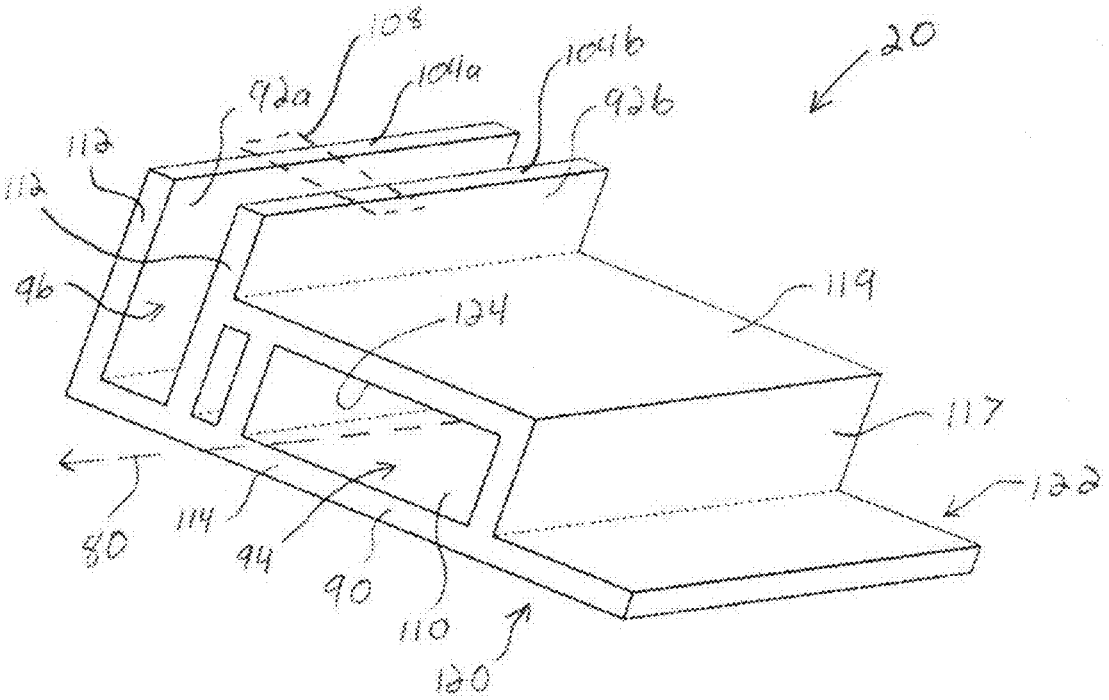
FIG. 6 is a perspective view of a rail section for use in forming the exemplary modular framing system of FIG. 1.

Turning now to FIG. 6, a longitudinally extending side rail 20 is depicted. The side rail 20 comprises a formed article having a unitary construction, in that it is formed as a single piece. For example, the one-piece part can be made preferably of a single material, e.g., a synthetic polymer such as nylon, polypropylene, or polyethylene with a molding process, such as an extrusion molding process. In other embodiments, the side rail 20 may be formed using an injection molding process.

The side rail 20 has a constant profile, such that the profile extends continuously along a full length of the respective side rail 20, along a respective longitudinal axis 80. The side rail 20 includes a base portion 90, raised rail portions 92*a* and 92*b*, and a rail channel 94.

The base portion 90 is generally planar and provides a generally flat surface for being received against a display surface, such as a wall or support stand. The raised wall portions 92*a* and 92*b* are configured in the manner of the raised wall portions 32*a* and 32*b* of the corner frame connections 18 to allow for mating of the wall portions 32*a* and 32*b* with the wall portions 92*a* and 92*b*.

The raised wall portions 92*a* and 92*b* each extend generally orthogonally from the base portion 90 and are spaced apart from one another to define therebetween a gap 96 for receiving and retaining a portion of an edge of the tensionable textile. The wall portions 92*a* and 92*b* define the gap 96 therebetween, with the wall portions 92*a* and 92*b* being equidistantly spaced apart at opposed axial ends of the wall portions 92*a* and 92*b*, and along the lengths of the wall portions 92*a* and 92*b*.

Each of the wall portions 92*a* and 92*b* extends generally orthogonally from the base portion 90 to respective generally planar faces 104*a* and 104*b* that are disposed in a common plane 108 that is generally parallel to a plane 110 along which the base portion 90 extends. Each of the wall portions 92*a* and 92*b* also extends laterally along the base portion 90 to opposite respective generally planar end faces 112 disposed in common with end faces 114 of the base portion 90. The end faces 112 and 114 are disposed orthogonal the plane 110 providing for easy and modular mating of the frame connections 18 and side rails 20.

The rail channel 94 is defined by a wall 117 extending from the base portion 90, a top wall 119 extending from the inner raised rail portion 92*b*, the base portion 90, and the raised rail portion 92*b*. The wall 117 and top wall 119 extend orthogonally relative to one another although other arrangements may be suitable. The rail channel 94 extends along a full length of the rail 20 between opposite ends 120 and 122 of the respective rail 20. The rail channel 94 has an inner profile 124 matching an outer profile 126 (FIGS. 3 to 5) of the protrusions 34, such as absent the ribs 64 (the ribs 64 not being considered in the profile shapes). The outer profiles 126 are disposed about the respective longitudinal axes 60 of the protrusions 34. The channel 94 is sized to receive therein a protrusion 34 of a respective corner frame connection 18 at each of the opposite ends 120 and 122 of the respective rail 20.

As is apparent from FIGS. 1 and 2, although not specifically illustrated with T-frame connections 218 omitted, four corner frame connections 18 may be interconnected with four side rails 20, with each of the protrusions 34 being received into respective channels 94. For example, the ribs 64 may allow for a tightly toleranced fit, such as a compression fit, between the protrusions 34 and the channels 94. When interconnected, the raised wall portions 32*a* and 32*b* of each corner frame connection 18 are spaced apart a distance equal to a spacing between the raised rail wall portions 92*a* and 92*b* of each of the rails 20 at each point along each pair of raised corner wall portions 32*a* and 32*b* and raised rail wall portions 92*a* and 92*b*. The gaps 40/96 therebetween interconnect to define a continuous conduit 130 (FIGS. 1 and 2) about the quadrilateral frame 12 for receiving therein respective edges of the tensionable textile.

Figure 7:
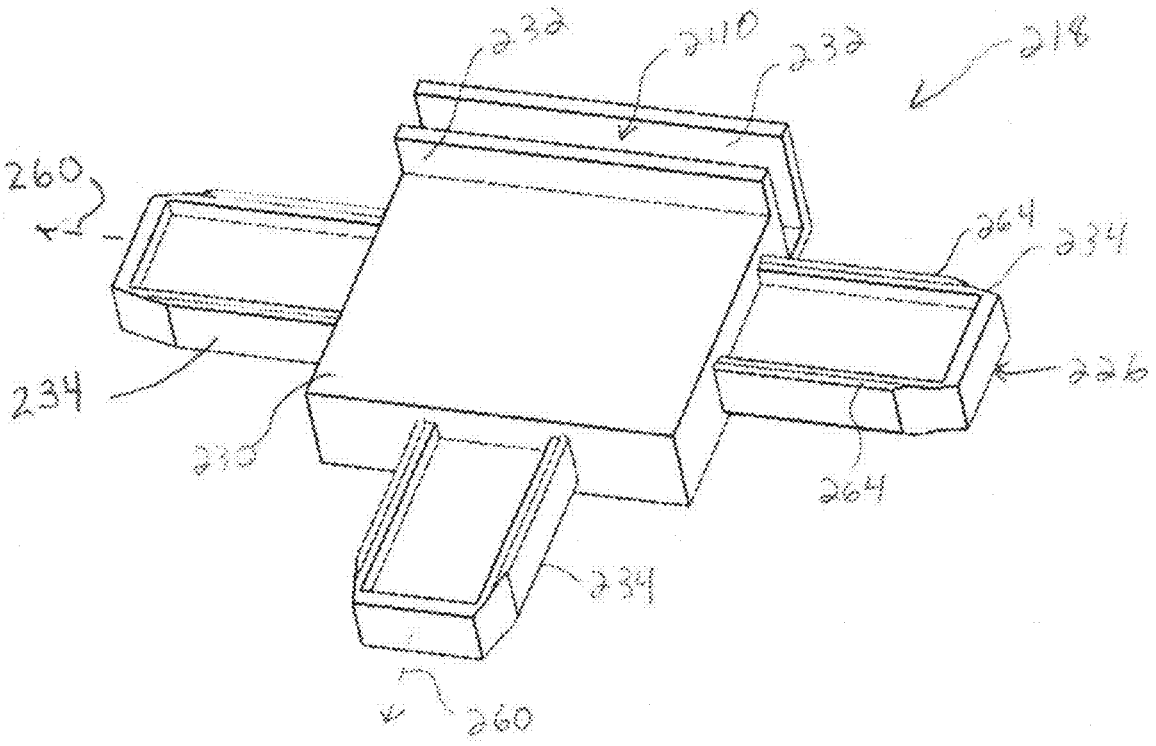
FIG. 7 is a perspective view of a T-frame connection for use in forming the exemplary modular framing system of FIG. 1.
Figure 8:
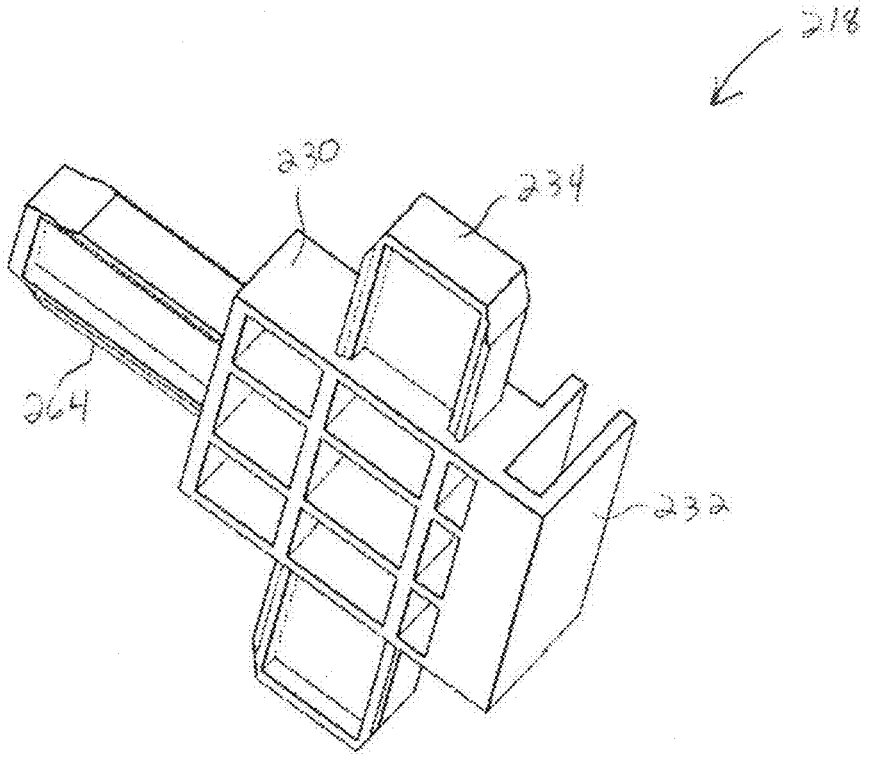
FIG. 8 is another perspective view of the T-frame connection of FIG. 7.
Figure 9:
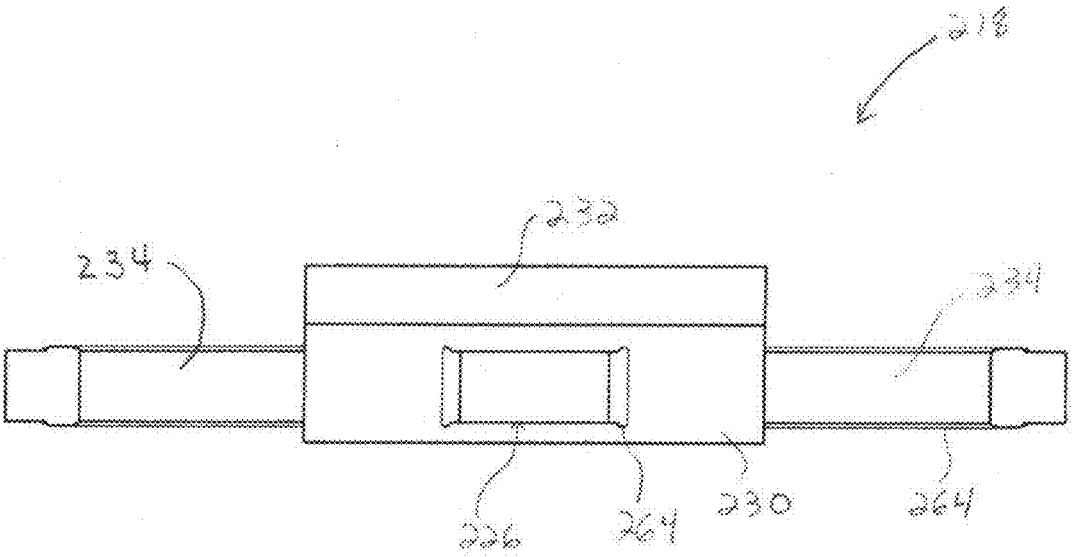
FIG. 9 is a side view of the T-frame connection of FIG. 7.

Turning now to FIGS. 7 to 9, T-frame connections 218 are illustrated that may be used to form an extended frame 12, as illustrated in FIGS. 1 and 2. In total, two T-frame connections 18 and at least four additional side rails 20 may be added to a system as described above, including four corner frame connections 18 and four initial side rails 20. It will be appreciated that a fifth additional side rail 20 may be provided for stability extending between the T-frame connections 18, as will be detailed below.

Each of the T-frame connections 218 includes a base portion 230, corresponding raised wall portions 232, and protrusions 234 extending along respective axes 260 and having ribs 264 and outer profiles 226. The raised wall portions 232 define a gap 240 therebetween. As shown, three protrusions 234 are included. Each of the three protrusions 234 extends from the base portion 230 in the same manner of the protrusions 34 of the corner frame portions 18 for being received by three different side rails 20.

Each T-frame connection 218 is interconnectable between a pair of corner frame connections 18 via the side rails 20, with one of the additional extending side rails 20 extending between the pair of T-frame connections 218 along an axis parallel to two end rails 20. The channel 94 of the side rails 20 is sized to receive therein a protrusion 234 of a respective T-frame connection 218 at each of the opposite ends 120 and 122 of the respective rail 20. Similar to the corner frame connections 18, the ribs 264 may allow for a tightly toleranced fit, such as a compression fit, between the protrusions 234 and the channels 94.

Each T-frame connection 218 comprises a single molded article having unitary construction, in that it is formed as a single piece. The raised wall portions 232 and the pair of protrusions 234 are formed in a manner that the raised wall portions 232 and protrusions 234 are integral with the base portion 230 at the forming of the raised wall portions 232 and protrusions 234. For example, the one-piece part can be made preferably of a single material, e.g., a synthetic polymer such as nylon, polypropylene, or polyethylene with a molding process, such as an injection molding process.

A side rail 20 extending between the T-frame connections 218 may have a same cross-section as the rails 20 extending between the T-frame connections 218 and corner frame connections 18, as illustrated in FIGS. 1 and 2.

Figure 10:
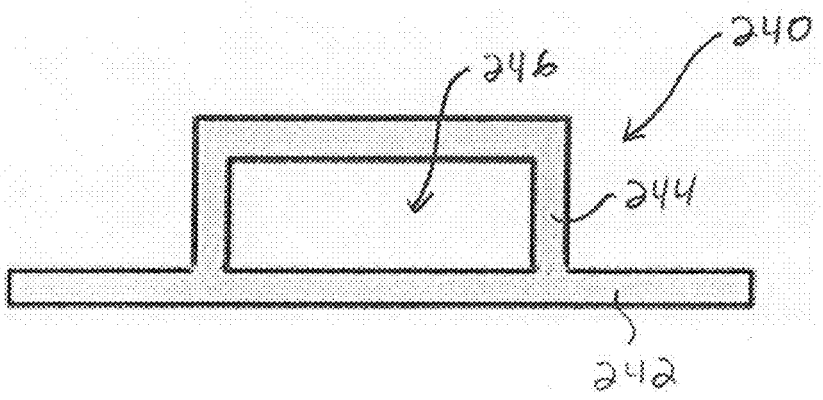
FIG. 10 is a side view of a rail that may be used to connect a pair of frame connections of the exemplary modular framing system of FIG. 1.

Turning to FIG. 10, in some embodiments, a rail extending between the T-frame connections 218 may be a center rail 240 having a base portion 242 and a central body portion 244 defining a channel 246. Raised wall portions may be omitted, such that a maximum upper elevation of the central body portion 244 (spaced orthogonally from the base portion 242) may be less than that of a maximum elevation of the raised wall portions 32, 232 from the respective base portions 30, 230.

Figure 11:
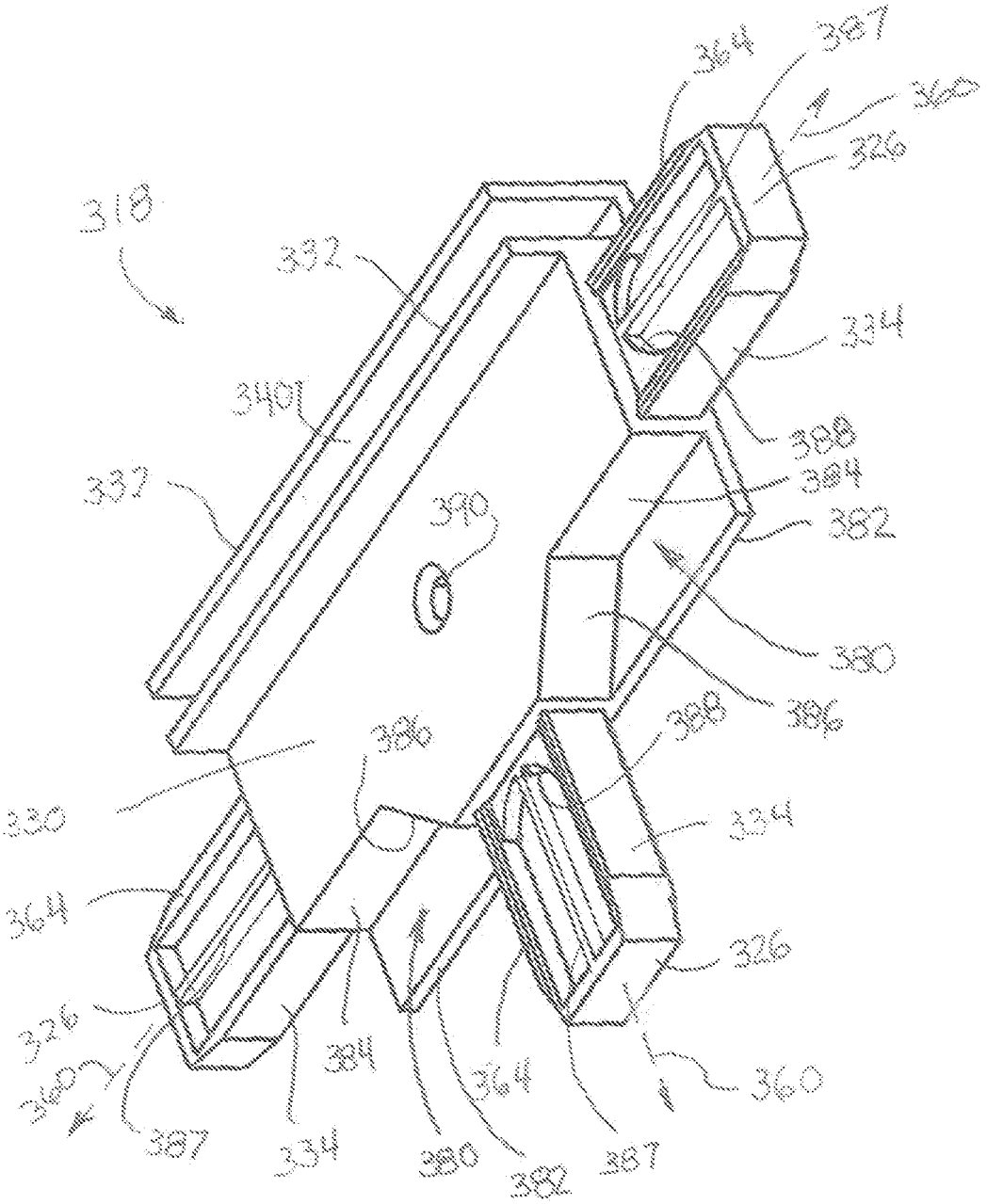
FIG. 11 is a perspective view of an alternate embodiment of a T-frame connection for use in forming the exemplary modular framing system of FIG. 1.

Turning now to FIG. 11, T-frame connection 318 may be used to form an extended frame 12. In total, two T-frame connections 18 and at least four additional side rails 20 may be added to a system as described above, including four corner frame connections 18 and four initial side rails 20. It will be appreciated that a fifth additional side rail 20 may be provided for stability extending between the T-frame connections 318, as will be detailed below.

T-frame connection 318 includes a base portion 330, corresponding raised wall portions 332, and protrusions 334 extending along respective axes 360 and having ribs 364 and outer profiles 326. The raised wall portions 332 define a gap 340 therebetween. The base portion 330 includes two cut-out sections 380. Each cut-out section 380 includes lower base wall 382, side wall 384 and angular side wall 386. As shown, three protrusions 334 are included. Each of the three protrusions 334 extends from the base portion 330 in the same manner of the protrusions 34 of the corner frame portions 18 for being received by three different side rails 20. Each protrusion 334 includes a central rib 387 and a semicircular buttress 388 to strengthen the protrusion 334 and enhance its resistance to breaking. These are shown in FIG. 11 on the top side of each protrusion 334, but can also be added on the other or bottom side of each protrusion 334. The protrusions 34 used with the corner frame member 18, and the protrusions 234 used with T-frame connection 218, may also employ central ribs and semicircular buttresses to strengthen such protrusions and enhance their resistance to breaking in a manner similar to the central rib 387 and semicircular buttress 388 used with the protrusions 318.

T-frame connection 318 is interconnectable between a pair of corner frame connections 18 via the side rails 20, with one of the additional extending side rails 20 extending between the pair of T-frame connections 318 along an axis parallel to two end rails 20. The channel 94 of the side rails 20 is sized to receive therein a protrusion 334 of a respective T-frame connection 318 at each of the opposite ends 120 and 122 of the respective rail 20. Similar to the corner frame connections 18, the ribs 364 may allow for a tightly toleranced fit, such as a compression fit, between the protrusions 334 and the channels 94.

Each T-frame connection 318 comprises a single molded article having unitary construction, in that it is formed as a single piece. The raised wall portions 332 and the three protrusions 334 are formed in a manner that the raised wall portions 332 and protrusions 334 are integral with the base portion 330 at the forming of the raised wall portions 332 and protrusions 334. For example, the one-piece part can be made preferably of a single material, e.g., a synthetic polymer such as nylon, polypropylene, or polyethylene with a molding process, such as an injection molding process.

A side rail 20 extending between the T-frame connections 318 may have a same cross-section as the rails 20 extending between the T-frame connections 318 and corner frame connections 18, as illustrated in FIGS. 1 and 2.

The T-frame 318 includes center hole 390 which can be used for mounting the modular framing system 10 on a wall. Corner frame members 18 may also include center holes for mounting the framing system 10.

Advantageously, T-frame connection 318 illustrated in FIG. 11, is twice as long as the T-frame connection 218 (FIGS. 7-9) and equals the length of two corner frame connections 18. This allows for standard size side rails 20 to work equally well if only corner frame members 18 are used on a given frame side, or if a combination of corner frame members 18 and T-frame connections 318 are used.

In other embodiments, the framing system 10 may include frame connections having other shapes, such as a cross, or an X, or such as having protrusions set at angles less than or greater than 90-degrees relative to one another. Such alternatively shaped frame connections may allow for alternatively shaped frames, other than a quadrilateral frame.

In summary, the present invention provides a modular framing system 10 comprising components 18, 20, 218 or 318 that each comprise a single article having unitary construction and which are connectable to form various sized SEG frames 12.

Four unitarily molded corner frame connections 18 each include protrusions 34 receivable by at least four side rails 20, each of which may be unitarily extruded with a constant profile along the respective lengths of the side rails 20. The interconnected corner frame connections 18 and side rails 20 define a continuous conduit 130 about the quadrilateral frame 12 for receiving therein respective edges of the tensionable textile. For use with larger tensionable textiles, additional side rails 20 and T-frame connections 218 or 318 may be utilized, with each of the T-frame connections 218 and 318 comprising a single molded article having unitary construction. At least the frame connections (both corner frame connections 18 and T-frame connections 218 or 318) may be reused for frames 12 of other sizes.

The present invention also provides a method of forming a silicone edge graphic frame 12. The method includes the step of (a) providing a frame connection 18, 218 or 318 including a generally planar base portion 30, 230 or 330, a pair of raised wall portions 32, 232 or 332 extending generally orthogonally from the base portion 30, 230 or 330 and being spaced apart from one another to define therebetween a gap 40, 96 for receiving and retaining a portion of an edge of the tensionable textile, and pair of protrusions 34, 234 or 334 extending outwardly from the base portion 30, 230 or 330 along respective longitudinal axes 60, 260 or 360 disposed parallel to a plane 50, 110 of the base portion 30, 230 or 330, the respective longitudinal axes 60, 260 or 360 extending in directions different from one another, and each protrusion 34, 234 or 334 includes a rib 64, 264 or 364 extending outwardly from a generally planar outer face of the respective protrusion 34, 234 or 334; each rib extends longitudinally along the planar outer face in a direction parallel to the respective longitudinal axis 60, 260 or 360 of the respective protrusion 34, 234 or 334, wherein the frame connection 18, 218 or 318 comprises a single molded article having unitary construction. The method also includes the step of (b) cutting a pair of side rails 20 each comprising a single formed article of unitary construction and having a constant profile over an entire length of the respective rail 20 along its respective longitudinal axis 80, the cutting including providing a straight cut set at 90-degrees to the longitudinal rail axis 80, and the profile including a channel 94 having an inner profile 124 conforming to an outer profile 126, 226 of the protrusions 34, 234 or 334 of the frame connection 18, 218 or 318 about the respective protrusion longitudinal axes 60, 260 or 360. The method further includes the step of (c) inserting each of the protrusions 34, 234 or 334 of the frame connection 18, 218 or 318 into a channel of a respective cut side rail 20, wherein the longitudinally extending ribs 64, 264 or 364 are received into the channel 94 having the inner profile 124 corresponding to the outer profile 126, 226 or 326 of the protrusion absent the rib 64, 264 or 364, thus allowing for a compression fit of the protrusion 34, 234 or 334 into the channel 18, 218 or 318. The frame connection 18, 218 or 318 may be a corner frame connection 18 where the pair of raised wall portions 32 each have a pair of sections 58 extending laterally along the base portion 30 and are disposed orthogonal one another.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention. The term "coupling" may refer to direct coupling of one integer to another or to indirect coupling of integers, such as with one or more integers therebetween. The term "and/or," such as used in "a and/or b" is defined as including either or both of (i) a and b and (ii) a or b.

The invention claimed is:

1. A frame connection for forming a part of a frame to display a tensionable textile, the frame connection comprising:

a generally planar base portion;

a pair of parallel raised wall portions extending generally orthogonally from the base portion and being spaced apart from one another to define therebetween a gap for receiving and retaining a portion of an edge of the tensionable textile; and a pair of protrusions extending outwardly from the base portion along respective longitudinal axes disposed parallel to a plane of the base portion, the respective longitudinal axes extending in directions different from one another, and each protrusion including a rib extending orthogonally outwardly from a generally planar outer face of the respective protrusion, each rib extending longitudinally along the planar outer face in a direction parallel to the respective longitudinal axis of the respective protrusion, wherein the frame connection comprises a single molded article having unitary construction.

2. The frame connection of claim 1 wherein the frame connection is composed of a synthetic polymer.

3. The frame connection of claim 1 wherein the pair of raised wall portions and the pair of protrusions are formed in a manner that the raised wall portions and protrusions are integral with the base portion at the forming of the raised wall portions and protrusions.

4. The frame connection of claim 1 wherein the raised wall portions extend laterally along the base portion to a generally planar end face in common with an end face of the base portion.

5. The frame connection of claim 1 wherein the raised wall portions each extend generally orthogonally from the base portion to respective generally planar faces disposed in a common plane generally parallel to the plane of the base portion.

6. The frame connection of claim 1 wherein each rib extends to an end face of the respective protrusion, the end face spaced from the base portion.

7. The frame connection of claim 1 wherein each rib extends to a tapered end face of the respective rib.

8. The frame connection of claim 1 wherein each rib is disposed along an edge of a generally planar face of the respective protrusion.

9. The frame connection of claim 1 wherein each of the ribs is configured to be crushable relative to the respective protrusion.

10. The frame connection of claim 1 wherein the respective longitudinal axes of the protrusions extend parallel to top faces of the pair of raised wall portions, the top faces being spaced from the base portion.

11. A method of forming a silicone edge graphic frame, the method including the steps of:

providing the frame connection of claim 1;

cutting a pair of side rails each comprising a single formed article of unitary construction and having a constant profile over an entire length of the respective rail along its respective longitudinal axis, the cutting including providing a straight cut set at 90 degrees to the longitudinal rail axis, and the profile including a channel having an inner profile conforming to an outer profile of the protrusions of the frame connection about the respective protrusion longitudinal axes;

inserting each of the protrusions of the frame connection into a channel of a respective cut side rail, wherein the longitudinally extending ribs are received into the channel having the inner profile corresponding to the outer profile of the protrusion absent the rib, thus allowing for a compression fit of the protrusion into the channel.

12. The method of claim 11, wherein the frame connection is a corner frame connection where the pair of raised wall portions each have a pair of sections extending laterally along the base portion and are disposed orthogonal one another.

13. A modular framing system for forming a frame to display a tensionable textile, the framing system comprising:

four corner frame connections each including a generally planar base portion, a pair of raised wall portions extending generally orthogonally from the base portion and being spaced apart from one another to define therebetween a gap for receiving and retaining a portion of an edge of the tensionable textile, the pair of raised wall portions each having a pair of sections extending laterally along the base portion and disposed orthogonal one another, and a pair of protrusions extending outwardly from the base portion along respective longitudinal axes disposed parallel to a plane of the base portion and orthogonal one another, and each protrusion including a rib extending outwardly from a generally planar outer face of the respective protrusion, each rib extending longitudinally along the planar outer face in a direction parallel to the respective longitudinal axis of the respective protrusion, wherein each corner frame connection comprises a single molded article having unitary construction; and four longitudinally extending side rails each comprising a formed article having a unitary construction and a profile extending continuously along a full length of the respective side rail, each side rail including a generally planar rail base portion, a pair of raised rail wall portions extending generally orthogonally from the rail base portion and being spaced apart from one another to define therebetween a gap for receiving and retaining a portion of an edge of the tensionable textile, and a rail channel extending a full length of the rail between opposite ends of the respective rail, the rail channel being sized to receive therein a protrusion of a respective corner frame connection at each of the opposite ends of the respective rail, wherein the four corner frame connections and four side rails are interconnectable to form a quadrilateral frame, and wherein the pair of raised wall portions of each corner frame connection are spaced apart a distance equal to a spacing between the pair of raised rail wall portions of each of the rails at each point along each pair of raised corner wall portions or raised rail wall portions, the gaps therebetween interconnecting to define a continuous conduit about the quadrilateral frame for receiving therein respective edges of the tensionable textile.

14. The modular framing system of claim 13, wherein each rail channel has an inner profile sized equivalent to an outer profile of the protrusions absent the additional outer profile of the ribs, the outer profile being disposed about the respective longitudinal axes of the protrusions.

15. The modular framing system of claim 13, further including four or more additional longitudinally extending side rails each comprising a formed article having a unitary construction and a profile extending continuously along a full length of the respective side rail; and a pair of T-frame connections, each having three protrusions extending therefrom for being received by three different side rails, and each T-frame connection being interconnectable between a pair of corner frame connections via the additional side rails, wherein each T-frame connection comprises a single molded article having a unitary construction.

16. The modular framing system of claim 15 wherein each protrusion of each T-frame connection includes at least one semicircular buttress and at least one central rib to strengthen the protrusion.

17. The modular framing system of claim 13, wherein the pair of T-frame connections are connectable to one another a fifth additional extending side rail extending between the pair of T-frame connections along an axis parallel to two end rails being two of the four longitudinally extending side rails.

18. The modular framing system of claim 13, wherein each of the frame connections and each of the side rails is composed of a synthetic polymer.

19. The modular framing system of claim 13, wherein each of the side rails is configured to be formed by an extrusion process.

* * * * *